US011825586B2

(12) United States Patent
Ootani et al.

(10) Patent No.: US 11,825,586 B2
(45) Date of Patent: Nov. 21, 2023

(54) HEATING COOKING APPARATUS

(71) Applicant: SHARP KABUSHIKI KAISHA, Sakai (JP)

(72) Inventors: Tsuyoshi Ootani, Sakai (JP); Masahiro Nishijima, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 427 days.

(21) Appl. No.: 17/133,992

(22) Filed: Dec. 24, 2020

(65) Prior Publication Data

US 2021/0251056 A1 Aug. 12, 2021

(30) Foreign Application Priority Data

Feb. 7, 2020 (JP) ..... 2020-019680

(51) Int. Cl.
*H05B 6/64* (2006.01)
*F24C 15/16* (2006.01)

(52) U.S. Cl.
CPC ..... *H05B 6/6408* (2013.01); *F24C 15/162* (2013.01)

(58) Field of Classification Search
CPC ..... H05B 6/64
USPC ..... 219/678
See application file for complete search history.

(56) References Cited

U.S. PATENT DOCUMENTS 2,205,064 A * 6/1940 Irwin ..... A47J 37/0694 99/426
2,912,554 A * 11/1959 Snyder ..... H05B 6/6408 219/736
6,386,096 B1 * 5/2002 Tiemann ..... A47J 43/18 99/449
7,188,619 B2 * 3/2007 Bollmers ..... F24C 15/18 126/340
2008/0053983 A1 * 3/2008 Stanger ..... A47J 39/006 219/393
2013/0119053 A1 * 5/2013 Linton ..... F24C 15/16 219/762
2013/0133528 A1 * 5/2013 Cheung ..... A47J 43/18 99/449

(Continued)

FOREIGN PATENT DOCUMENTS

DE 202007007450 U1 * 9/2007 ..... F24C 15/162
DE 102013215840 A1 * 2/2015 ..... H05B 6/6408

(Continued)

*Primary Examiner* — Tu B Hoang
*Assistant Examiner* — Damon Joel David Alfaro
(74) *Attorney, Agent, or Firm* — ScienBiziP, P.C.

(57) ABSTRACT

A heating cooking apparatus includes a microwave supply unit, a drawer portion, and a grid body made of metal. The microwave supply unit is configured to supply microwaves to a heating cooking chamber. The drawer portion is drawable with respect to the heating cooking chamber. A heated object is placed on the grid body. The drawer portion includes a moving body made of metal and an engagement portion made of non-metallic material. The moving body is configured to move between an accommodation position inside the heating cooking chamber and a drawn-out position outside the heating cooking chamber. The engagement portion is disposed on the moving body. When the moving body is at the drawn-out position, the grid body is engageable with the engagement portion.

4 Claims, 13 Drawing Sheets

(56) References Cited

U.S. PATENT DOCUMENTS

| | | | | |
|---|---|---|---|---|
| 2015/0359046 | A1* | 12/2015 | Mohseni | H05B 6/6414 219/393 |
| 2016/0014852 | A1* | 1/2016 | Metz | H05B 6/76 219/756 |
| 2017/0035244 | A1* | 2/2017 | Chatot | A23L 5/15 |
| 2017/0171921 | A1* | 6/2017 | Nasu | H05B 6/6414 |
| 2018/0073743 | A1* | 3/2018 | Adelmann | F24C 11/00 |
| 2020/0025392 | A1* | 1/2020 | Balekundri | F24C 15/028 |
| 2020/0253004 | A1* | 8/2020 | Carcano | H05B 6/686 |
| 2021/0108802 | A1* | 4/2021 | Mills | F24C 15/023 |

FOREIGN PATENT DOCUMENTS

| | | | | | |
|---|---|---|---|---|---|
| EP | 2063186 | A2 | * | 5/2009 | F24C 15/162 |
| GB | 2524042 | A | * | 9/2015 | A47B 37/0694 |
| JP | 2011-089738 | A | | 5/2011 | |
| JP | 2011089738 | A | * | 5/2011 | |
| KR | 20090099946 | A | * | 3/2008 | |
| KR | 20110085010 | A | * | 1/2010 | |

* cited by examiner

HEATING COOKING APPARATUS

CROSS-REFERENCE TO RELATED APPLICATIONS

This application claims the benefit of priority to Japanese Patent Application Number 2020-019680 filed on Feb. 7, 2020. The entire contents of the above-identified application are hereby incorporated by reference.

BACKGROUND

Technical Field

The present disclosure relates to a heating cooking apparatus.

JP 2011-89738 A discloses a heating cooking apparatus. The heating cooking apparatus disclosed in JP 2011-89738 A includes a heating chamber, a receiving tray, a rail unit, a gridiron, and a damper. The rail unit is for moving the receiving tray into and out of the heating chamber. The damper mitigates impact upon retraction. The gridiron is placed on the receiving tray. An object to be cooked is placed on the gridiron.

SUMMARY

However, in the heating cooking apparatus disclosed in JP 2011-89738 A, a grid body such as a gridiron may move out of a predetermined range with respect to a moving body such as a receiving tray. In particular, in a case where an object to be cooked is heated using microwaves, if the grid body moves out of the predetermined range, the distance between the grid body and another metal member becomes short. As a result, electric discharge may occur between the grid body and the other metal member.

In light of the above problems, an object of the present disclosure is to provide a heating cooking apparatus capable of suppressing movement of a grid body with respect to a moving body caused by impact when a moving body moves.

According to an aspect of the present disclosure, a heating cooking apparatus includes a microwave supply unit, a drawer portion, and a grid body made of metal. The microwave supply unit is configured to supply microwaves to a heating cooking chamber. The drawer portion is drawable with respect to the heating cooking chamber. A heated object is placed on the grid body. The drawer portion includes a moving body made of metal and an engagement portion made of non-metallic material. The moving body is configured to move between an accommodation position inside the heating cooking chamber and a drawn-out position outside the heating cooking chamber. The engagement portion is disposed on the moving body. When the moving body is at the drawn-out position, the grid body is engageable with the engagement portion.

According to the heating cooking apparatus of the present disclosure, it is possible to suppress movement of the grid body with respect to the moving body caused by impact when the moving body moves.

BRIEF DESCRIPTION OF DRAWINGS

The disclosure will be described with reference to the accompanying drawings, wherein like numbers reference like elements.

DESCRIPTION OF EMBODIMENTS

Figure 1:
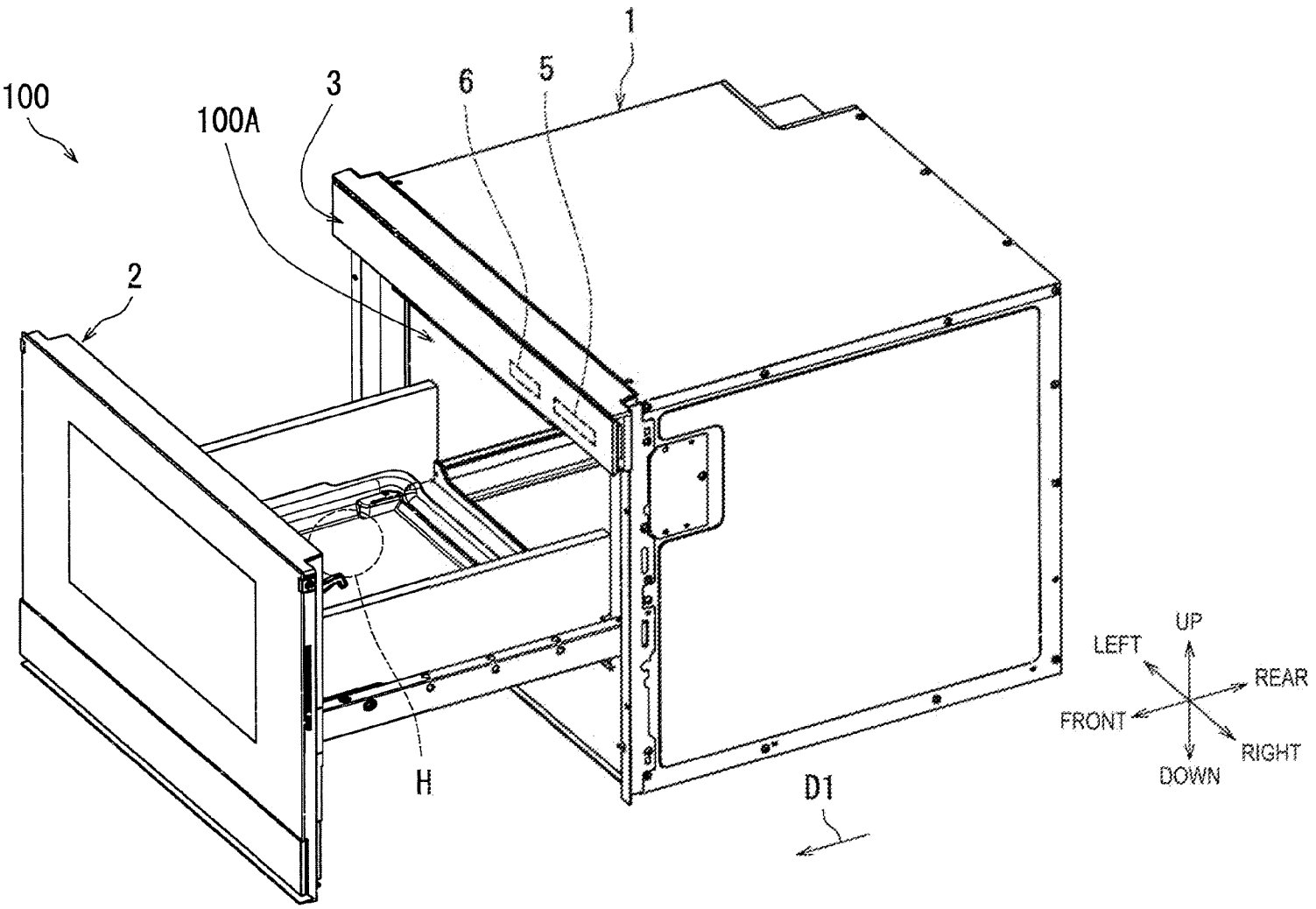
FIG. 1 is a perspective view of a drawer type heating cooking apparatus according to an embodiment of the present disclosure.

An embodiment of a drawer type heating cooking apparatus according to the present disclosure will be described below with reference to the drawings. Note that, in the drawings, the same or equivalent components are denoted by the same reference signs and description thereof will not be repeated.

Figure 2:
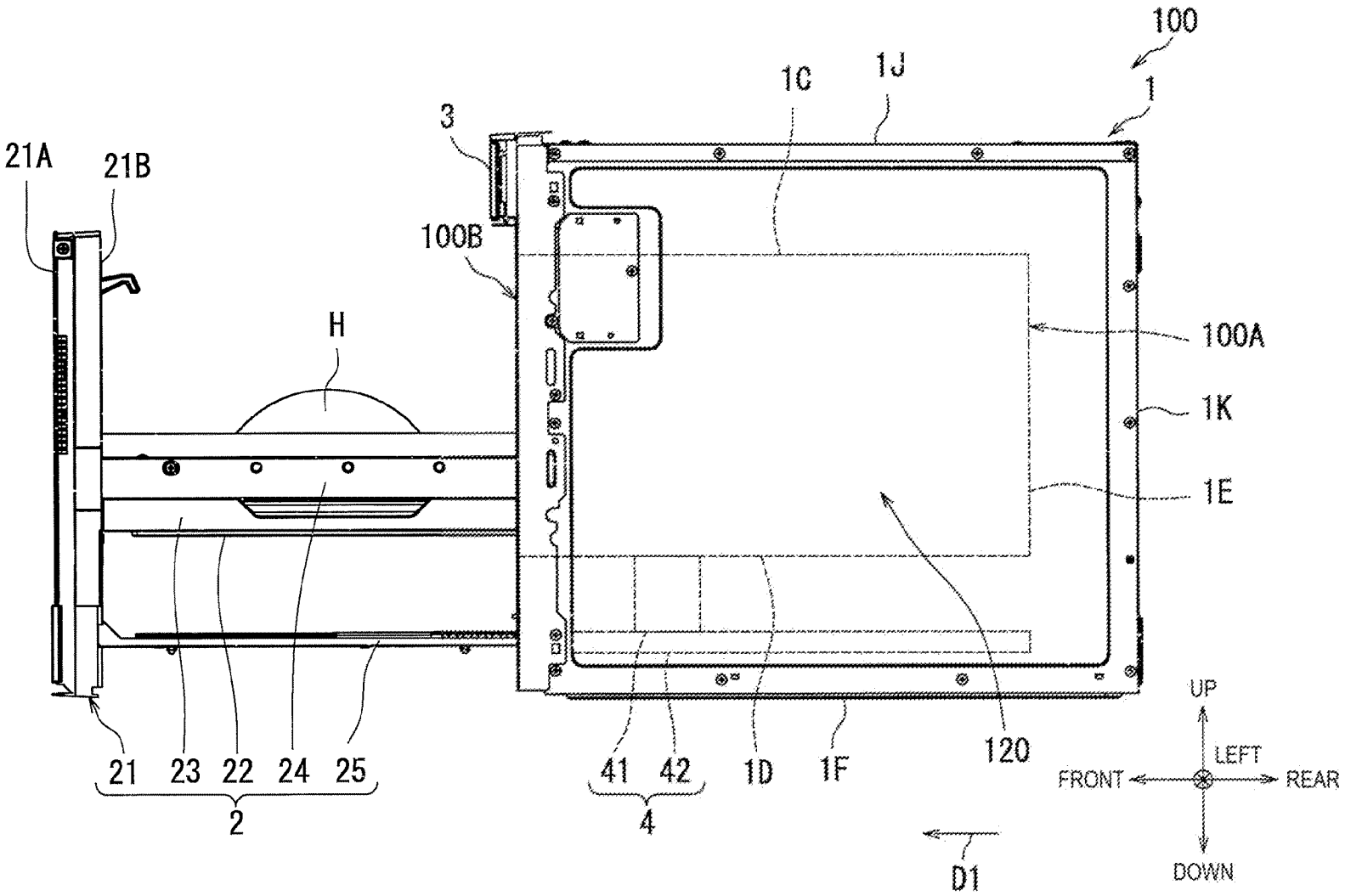
FIG. 2 is a right side view of the drawer type heating cooking apparatus according to the present embodiment.
Figure 3:
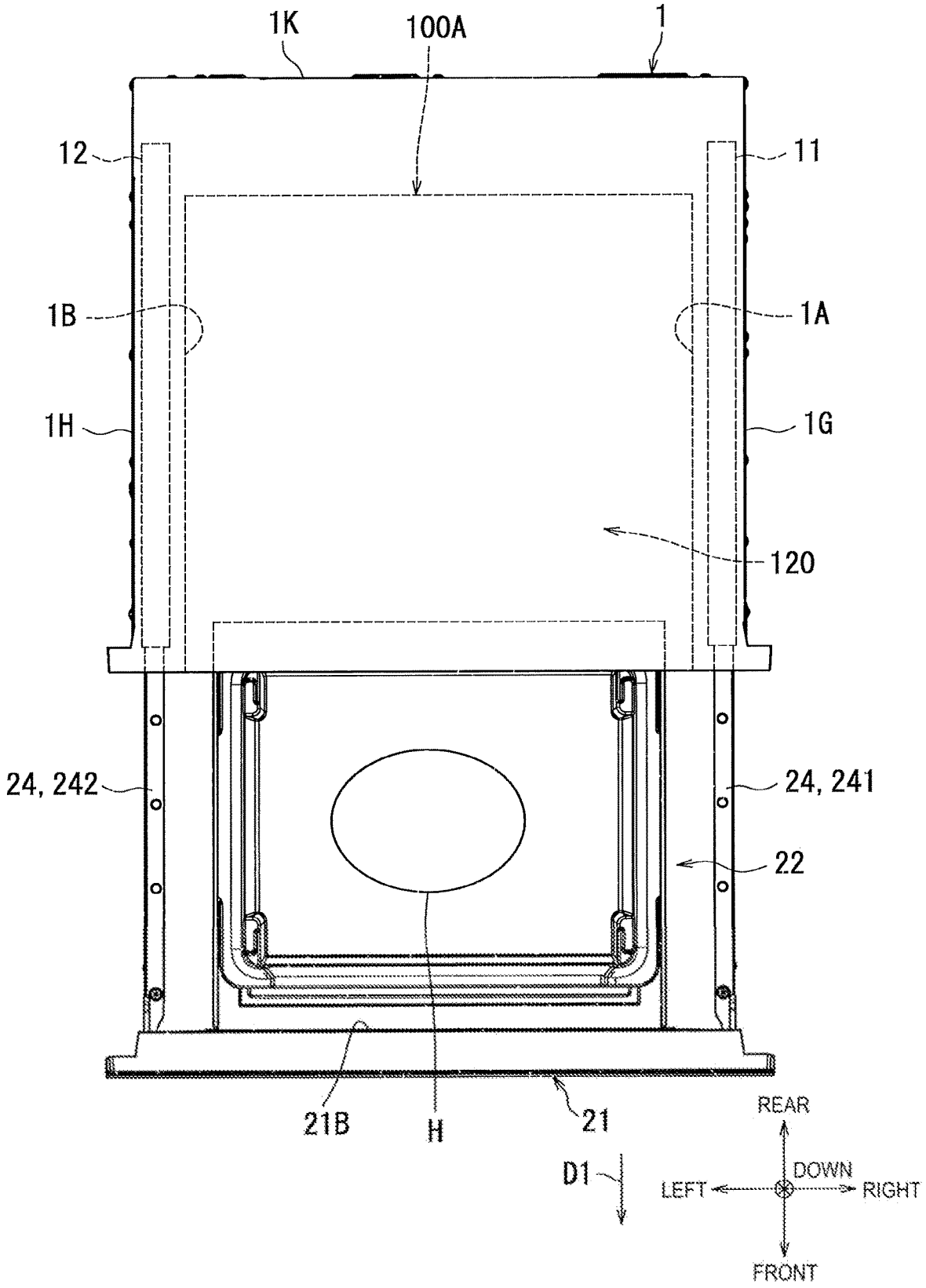
FIG. 3 is a top view of the drawer type heating cooking apparatus according to the present embodiment.

A drawer type heating cooking apparatus 100 according to the present embodiment will be described with reference to FIGS. 1 to 3. FIG. 1 is a perspective view of the drawer type heating cooking apparatus 100. FIG. 2 is a right side view of the drawer type heating cooking apparatus 100. FIG. 3 is a top view of the drawer type heating cooking apparatus 100. In particular, FIGS. 1 to 3 illustrate the drawer type heating cooking apparatus 100 with a drawer body 2 being drawn out. FIG. 1 illustrates the appearance of the drawer type heating cooking apparatus 100 when viewed from above at a diagonally forward right position. The drawer type heating cooking apparatus 100 is one example of a heating cooking apparatus.

The drawer type heating cooking apparatus 100 heats and cooks a heated object H. The heated object H is, for example, food. As illustrated in FIG. 1, the drawer type heating cooking apparatus 100 includes a heating chamber 1, the drawer body 2, an operation panel 3, a control unit 5, and a storage unit 6. The drawer body 2 is an example of a drawer portion.

In the present embodiment, a side on which the operation panel 3 of the drawer type heating cooking apparatus 100 is disposed is defined as a front side of the drawer type heating cooking apparatus 100, and an opposite side thereof (the back side) is defined as a rear side of the drawer type heating cooking apparatus 100. Further, a right side when the drawer type heating cooking apparatus 100 is viewed from the front side is defined as a right side of the drawer type heating cooking apparatus 100, and an opposite side thereof is defined as a left side of the drawer type heating cooking apparatus 100. Further, in a direction orthogonal to a front-rear direction and a left-right direction of the drawer type heating cooking apparatus 100, a side on which the operation panel 3 is disposed is defined as an upper side of the drawer type heating cooking apparatus 100, and an opposite side thereof (the bottom side) is defined as a lower side of the drawer type heating cooking apparatus 100. Note that these directions do not limit an orientation of the drawer type heating cooking apparatus 100 according to the present disclosure in use.

As illustrated in FIGS. 1 to 3, the heating chamber 1 is a box-like member. Specifically, the heating chamber 1 includes a right outer wall 1G, a left outer wall 1H, a top outer wall 1J, a bottom outer wall 1F, and a back outer wall 1K. The heating chamber 1 includes a heating cooking chamber 100A therein.

The heating cooking chamber 100A includes an accommodation space 120 that accommodates the heated object H. The accommodation space 120 has a predetermined volume as a space that can accommodate the heated object H. The heating cooking chamber 100A further includes a right wall 1A, a left wall 1B, a top wall 1C, a bottom wall 1D, and a back wall 1E. A shape of the heating cooking chamber 100A is, for example, a substantially rectangular parallelepiped. A material of the right wall 1A, the left wall 1B, the top wall 1C, the bottom wall 1D, and the back wall 1E is, for example, metal. The heating cooking chamber 100A further includes an opening 100B that communicates with the outside of the heating cooking chamber 100A. Specifically, the front side of the heating cooking chamber 100A has an opening for allowing the heated object H to be placed in and removed from the heating cooking chamber 100A.

The heating chamber 1 further includes a space between the bottom wall 1D and the bottom outer wall 1F. The heating chamber 1 further includes a space between the right wall 1A and the right outer wall 1G. The heating chamber 1 further includes a space between the left wall 1B and the left outer wall 1H. The heating chamber 1 further includes a space between the top wall 1C and the top outer wall 1J. The heating chamber 1 further includes a space between the back wall 1E and the back outer wall 1K.

The operation panel 3 includes an operation unit and a display unit. The operation unit receives an operation from a user. The operation unit includes various types of keys. The display unit displays various pieces of information. The display unit includes a liquid crystal panel. The operation panel 3 is located on an upper portion of a front surface of the heating chamber 1.

The storage unit 6 includes a random access memory (RAM) and a read only memory (ROM). The storage unit 6 stores control programs used for controlling operations of each part of the drawer type heating cooking apparatus 100. The storage unit 6 stores setting information input when the operation panel 3 is operated.

The control unit 5 is a hardware circuit including a processor such as a central processing unit (CPU). The control unit 5 executes the control programs stored in the storage unit 6.

Figure 4:
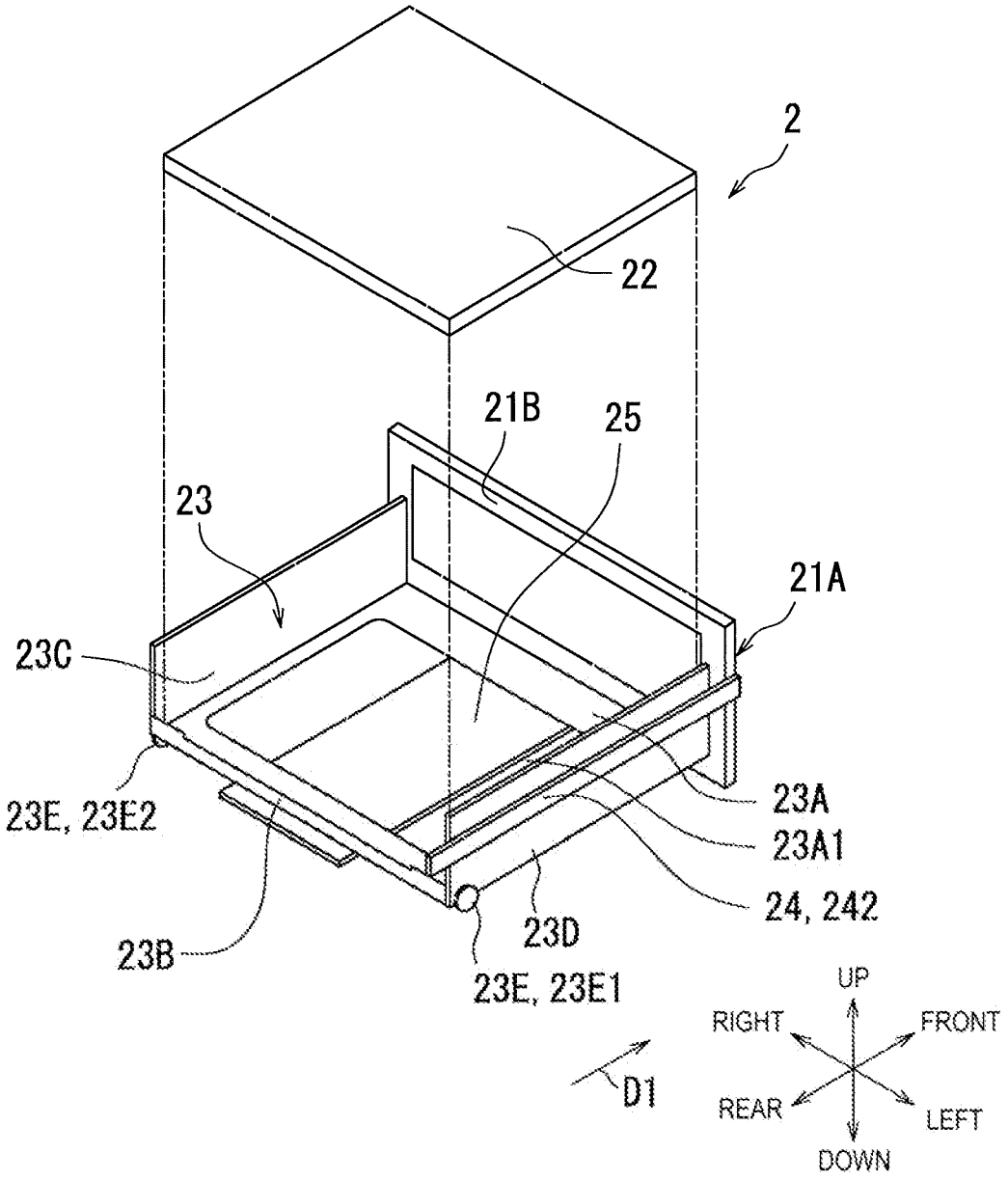
FIG. 4 is an exploded perspective view of a drawer body according to the present embodiment.

Next, the drawer body 2 according to the present embodiment will be described with reference to FIGS. 1 to 4. FIG. 4 is an exploded perspective view of the drawer body 2. As illustrated in FIGS. 1 to 4, the drawer body 2 is drawn out of the heating cooking chamber 100A along a first direction D1. The first direction D1 is along a direction from the rear side toward the front side.

Specifically, the drawer body 2 can be drawn out and retracted with respect to the heating chamber 1. Specifically, the drawer body 2 includes a door portion 21, a placement portion 22, and a support portion 23. The support portion 23 is an example of a moving body.

The door portion 21 can open and close the opening 100B on the front side of the heating cooking chamber 100A. The door portion 21 is a substantially rectangular plate-like member. The door portion 21 includes a front surface 21A and a rear surface 21B. The door portion 21 opens the opening 100B on the front side of the heating cooking chamber 100A in a state in which the drawer body 2 is drawn out of the heating cooking chamber 100A. The door portion 21 closes the opening 100B on the front side of the heating cooking chamber 100A in a state in which the drawer body 2 is retracted in the heating cooking chamber 100A. The distance between the top wall 1C and the bottom wall 1D is shorter than the distance between the back wall 1E and the rear surface 21B, in a state in which the drawer body 2 is retracted in the heating cooking chamber 100A.

The heated object H can be placed on the placement portion 22. The placement portion 22 is, for example, a plate-like member made of ceramic, glass, or a synthetic resin, and preferably, a plate-like member made of ceramic or glass. As a result, the placement portion 22 transmits microwaves.

The support portion 23 is fixed to the rear surface 21B of the door portion 21, and supports a peripheral edge of the placement portion 22 such that the placement portion 22 is maintained horizontally. Specifically, the support portion 23 includes a bottom plate portion 23A, a back plate portion 23B, a right plate portion 23C, a left plate portion 23D, and a pair of rollers 23E. The material of the support portion 23 is, for example, a metal.

The bottom plate portion 23A has a rectangular opening 23A1. The rectangular opening 23A1 is located substantially at a center of the bottom plate portion 23A.

The back plate portion 23B, the right plate portion 23C, and the left plate portion 23D stand from the peripheral edge of the bottom plate portion 23A so as to extend upward. The placement portion 22 is fitted into a space formed between the door portion 21 and the back plate portion 23B and between the right plate portion 23C and the left plate portion 23D. The peripheral edge of the placement portion 22 is fixed to the upper surface of the peripheral edge of the bottom plate portion 23A.

The pair of rollers 23E rotate as the drawer body 2 moves. Specifically, the pair of rollers 23E includes a right roller 23E1 and a left roller 23E2. The right roller 23E1 is attached to the rear end of the right plate portion 23C. The left roller 23E2 is attached to the rear end of the left plate portion 23D.

When the drawer body 2 is drawn outward, the placement portion 22 and the support portion 23 inside the heating cooking chamber 100A is drawn outward. When the drawer body 2 is in the retracted state, the placement portion 22 and the support portion 23 are accommodated in the heating cooking chamber 100A. That is, the support portion 23 moves between an accommodation position inside the heating cooking chamber 100A and a drawn-out position outside the heating cooking chamber 100A.

The drawer body 2 further includes a pair of slide members 24 and a support member 25.

Furthermore, the pair of slide members 24 extend in the front-rear direction and define the direction of movement of the drawer body 2. The pair of slide members 24 are fixed to the rear surface 21B of the door portion 21.

Specifically, the pair of slide members 24 includes a right slide member 241 and a left slide member 242. Each of the right slide member 241 and the left slide member 242 has a longitudinal direction along in the front-rear direction, for example. The right slide member 241 and the left slide member 242 face each other in the left-right direction. One end of the right slide member 241 is attached to the right edge of the rear surface 21B of the door portion 21. One end of the left slide member 242 is attached to the left edge of the rear surface 21B of the door portion 21.

The heating chamber 1 further includes a right slide rail 11 and a left slide rail 12. The right slide rail 11 is fixed in the space between the right wall 1A and the right outer wall 1G. The left slide rail 12 is fixed in the space between the left wall 1B and the left outer wall 1H. Each of the right slide rail 11 and the left slide rail 12 has a longitudinal direction along in the front-rear direction. The right slide member 241 is slidably supported by the right slide rail 11. The left slide member 242 is slidably supported by the left slide rail 12.

The support member 25 supports the door portion 21. Specifically, the support member 25 extends in the first direction D1 and defines the direction of movement of the drawer body 2. One end of the support member 25 is attached to a central portion in the left-right direction of the rear surface 21B of the door portion 21 and below the placement portion 22. The support member 25 is a plate-like member having a longitudinal direction along in the front-rear direction, for example. The support member 25 includes a rack portion. The rack portion includes a plurality of teeth. The support member 25 may be a single plate-like member or may be a plurality of plate-like members.

As illustrated in FIG. 2, the heating chamber 1 further includes a drive mechanism 4. The drive mechanism 4 drives the support member 25. The drive mechanism 4 is located below the heating cooking chamber 100A. Specifically, the drive mechanism 4 is accommodated in the space between the bottom wall 1D and the bottom outer wall 1F. For example, the drive mechanism 4 includes a drive motor 41, a pinion, and a drive rail 42. The drive rail 42 is fixed in the space between the bottom wall 1D and the bottom outer wall 1F. The drive rail 42 is a member having a longitudinal direction along in the front-rear direction. The support member 25 is slidably supported by the drive rail 42. The pinion is attached to an end of the drive motor 41. The pinion meshes with the rack portion of the support member 25. As the pinion rotates, the support member 25 is moved in the front-rear direction. As a result, the drawer body 2 moves between the accommodation position and the drawn-out position. Note that the drive mechanism 4 may drive at least one of the support member 25, the right slide member 241, and the left slide member 242. In a case where the drive mechanism 4 drives the right slide member 241 and the left slide member 242, the drive mechanism 4 may be located on a lateral side of the heating cooking chamber 100A.

Figure 5:
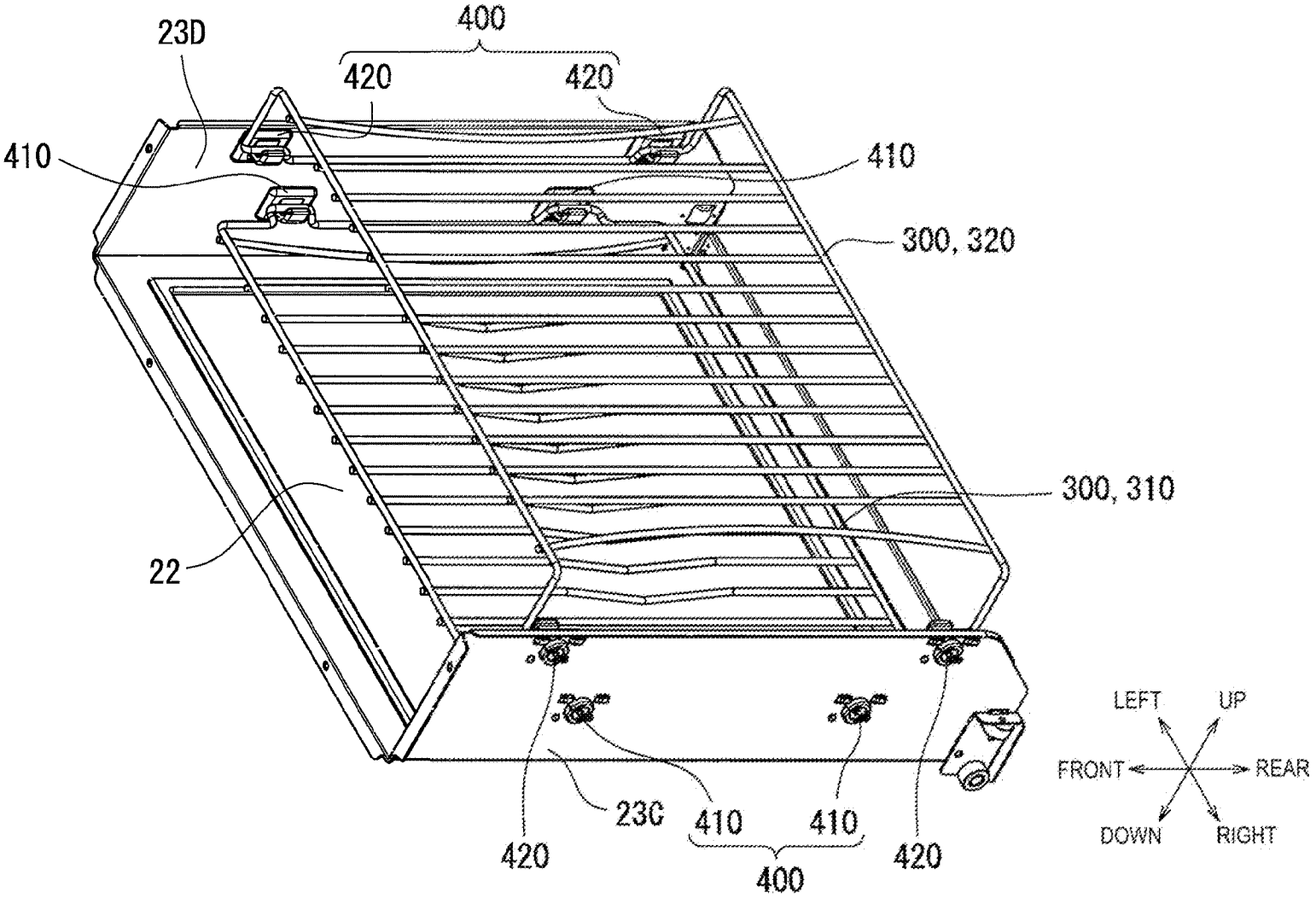
FIG. 5 is a perspective view of a plurality of grid bodies and a support portion according to the present embodiment.
Figure 6:
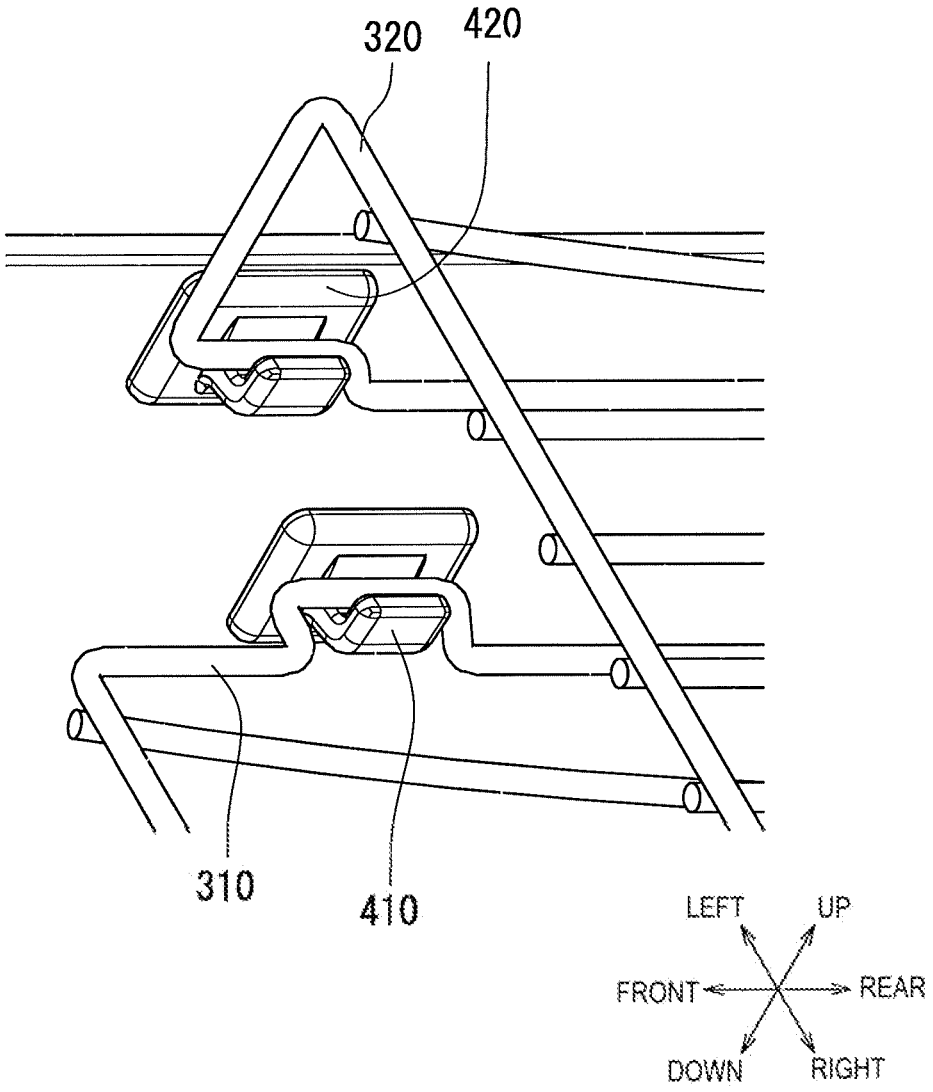
FIG. 6 is a partially enlarged view of the grid bodies and the support portion illustrated in FIG. 5.

Referring to FIGS. 5 and 6, a grid body 300 will be described in detail. FIG. 5 is a perspective view of a plurality of the grid bodies 300 and the support portion 23. FIG. 6 is a partially enlarged view of the grid bodies 300 and the support portion 23 illustrated in FIG. 5. The drawer type heating cooking apparatus 100 further includes the grid body 300. Specifically, the drawer type heating cooking apparatus 100 further includes at least one grid body 300. Specifically, the at least one grid body 300 includes a first grid body 310 and a second grid body 320.

As illustrated in FIGS. 5 and 6, the support portion 23 further includes a plurality of engagement portions 400. Each of the plurality of engagement portions 400 is disposed on the support portion 23. Specifically, the plurality of engagement portions 400 includes a plurality of first engagement portions 410 and a plurality of second engagement portions 420.

The plurality of first engagement portions 410 includes four first engagement portions 410, for example. Each of the four first engagement portions 410 is, for example, a substantially L-shaped hook. Furthermore, each of the four first engagement portions 410 are made of a non-metallic material, for example, a heat-resistant synthetic resin. Two first engagement portions 410 of the four first engagement portions 410 are attached to the right plate portion 23C. The other two first engagement portions 410 of the four first engagement portions 410 are attached to the left plate portion 23D.

The plurality of second engagement portions 420 includes four second engagement portions 420, for example. Each of the four second engagement portions 420 is, for example, a substantially L-shaped hook. Furthermore, each of the four second engagement portions 420 are made of a non-metallic material, for example, a heat-resistant synthetic resin. Two second engagement portions 420 of the four second engagement portions 420 are attached to the right plate portion 23C. The other two second engagement portions 420 of the four second engagement portions 420 are attached to the left plate portion 23D. Specifically, the second engagement portions 420 are disposed on the support portion 23 and above the first engagement portions 410.

Figure 7:
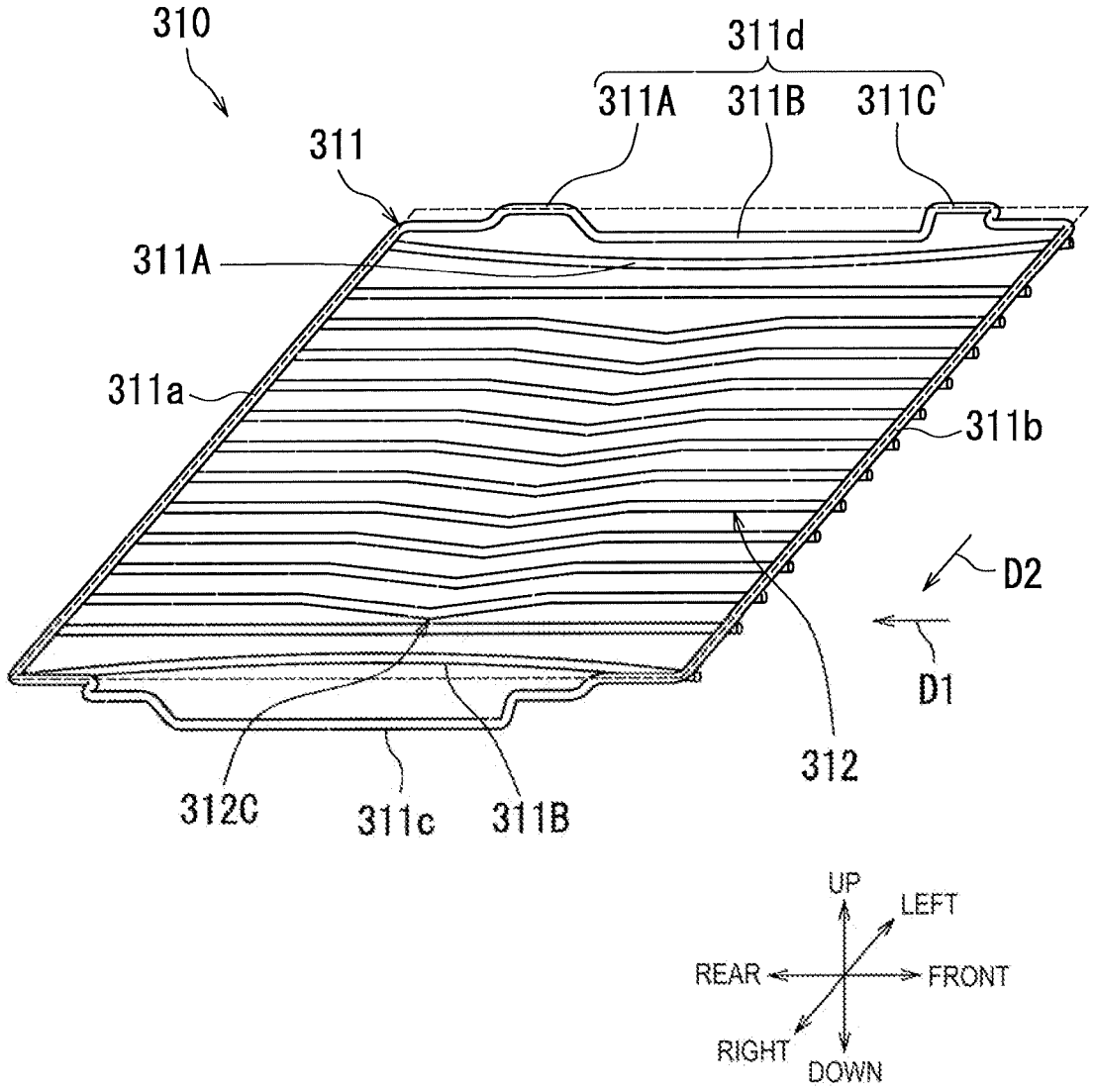
FIG. 7 is a perspective view of a first grid body according to the present embodiment.

Next, the first grid body 310 will be described in detail with reference to FIG. 7. FIG. 7 is a perspective view of the first grid body 310.

As illustrated in FIG. 7, the first grid body 310 includes a frame 311 and a placement portion 312. The shape of the frame 311 is, for example, a substantially rectangular ring shape. Specifically, the frame 311 includes a front metal rod 311*a*, a rear metal rod 311*b*, a right metal rod 311*c*, and a left metal rod 311*d*. Each of the right metal rod 311*c* and the left metal rod 311*d* has a first high portion 311A, a low portion 311B, and a second high portion 311C. The first high portion 311A, the low portion 311B, and the second high portion 311C are examples of grid body restricting portions. The low portion 311B is provided between the first high portion 311A and the second high portion 311C. Each of the first high portion 311A and the second high portion 311C is at the same height as each of the front metal rod 311*a* and the rear metal rod 311*b*. Additionally, the low portion 311B is at a lower position than each of the first high portion 311A and the second high portion 311C.

The placement portion 312 includes a plurality of metal rods. Each of the plurality of metal rods extends along the first direction D1. Specifically, one end of each of the plurality of metal rods is coupled to the front metal rod 311*a*, and the other end of each of the plurality of metal rods is coupled to the rear metal rod 311*b*. In addition, the plurality of metal rods are disposed so that adjacent metal rods are separated by a predetermined distance in a second direction D2. The second direction D2 intersects the first direction D1. The second direction D2 is along a direction from the left side to the right side. The heated object H is placed on the plurality of metal rods.

Figure 8:
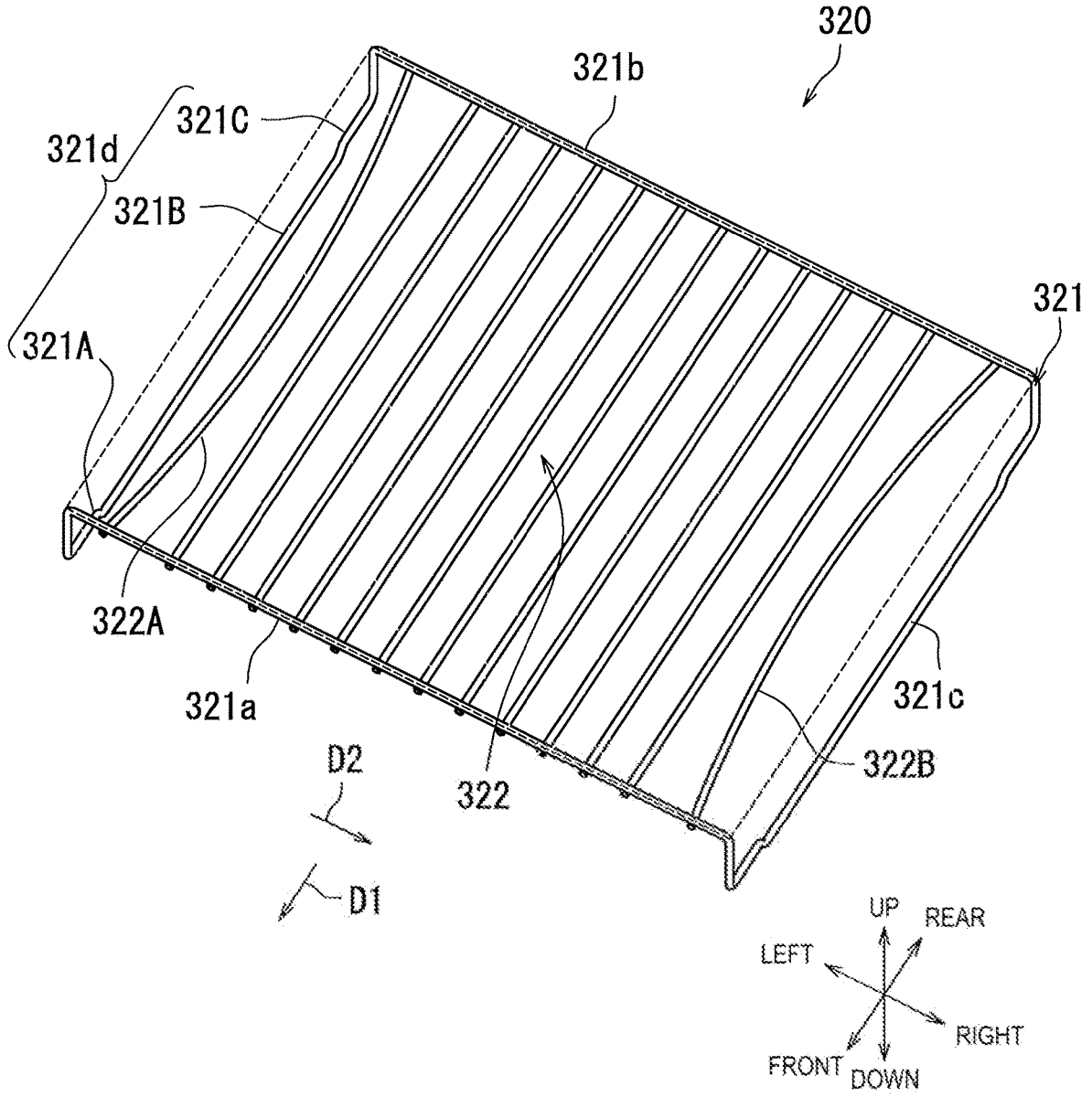
FIG. 8 is a perspective view of a second grid body according to the present embodiment.

Next, the second grid body 320 will be described in detail with reference to FIG. 8. FIG. 8 is a perspective view of the second grid body 320.

As illustrated in FIG. 8, the second grid body 320 has a frame 321 and a placement portion 322. The shape of the frame 321 is, for example, a substantially rectangular ring shape. Specifically, the frame 311 includes a front metal rod 321*a*, a rear metal rod 321*b*, a right metal rod 321*c*, and a left metal rod 321*d*. Each of the right metal rod 321*c* and the left metal rod 321*d* has a first high portion 321A, a low portion 321B, and a second high portion 321C. The first high portion 321A, the low portion 321B, and the second high portion 321C are examples of grid body restricting portions. The low portion 321B is provided between the first high portion 321A and the second high portion 321C. Each of the first high portion 321A and the second high portion 321C is at a lower position than each of the front metal rod 321*a* and the rear metal rod 321*b*. Additionally, the low portion 321B is at a lower position than each of the first high portion 321A and the second high portion 321C.

The placement portion 322 includes a plurality of metal rods. Each of the plurality of metal rods extends along the first direction D1. Specifically, one end of each of the plurality of metal rods is coupled to the front metal rod 321*a*, and the other end of each of the plurality of metal rods is coupled to the rear metal rod 321*b*. In addition, the plurality of metal rods are disposed so that adjacent metal rods are separated by a predetermined distance in the second direction D2. The heated object H is placed on the plurality of metal rods.

Figure 9:
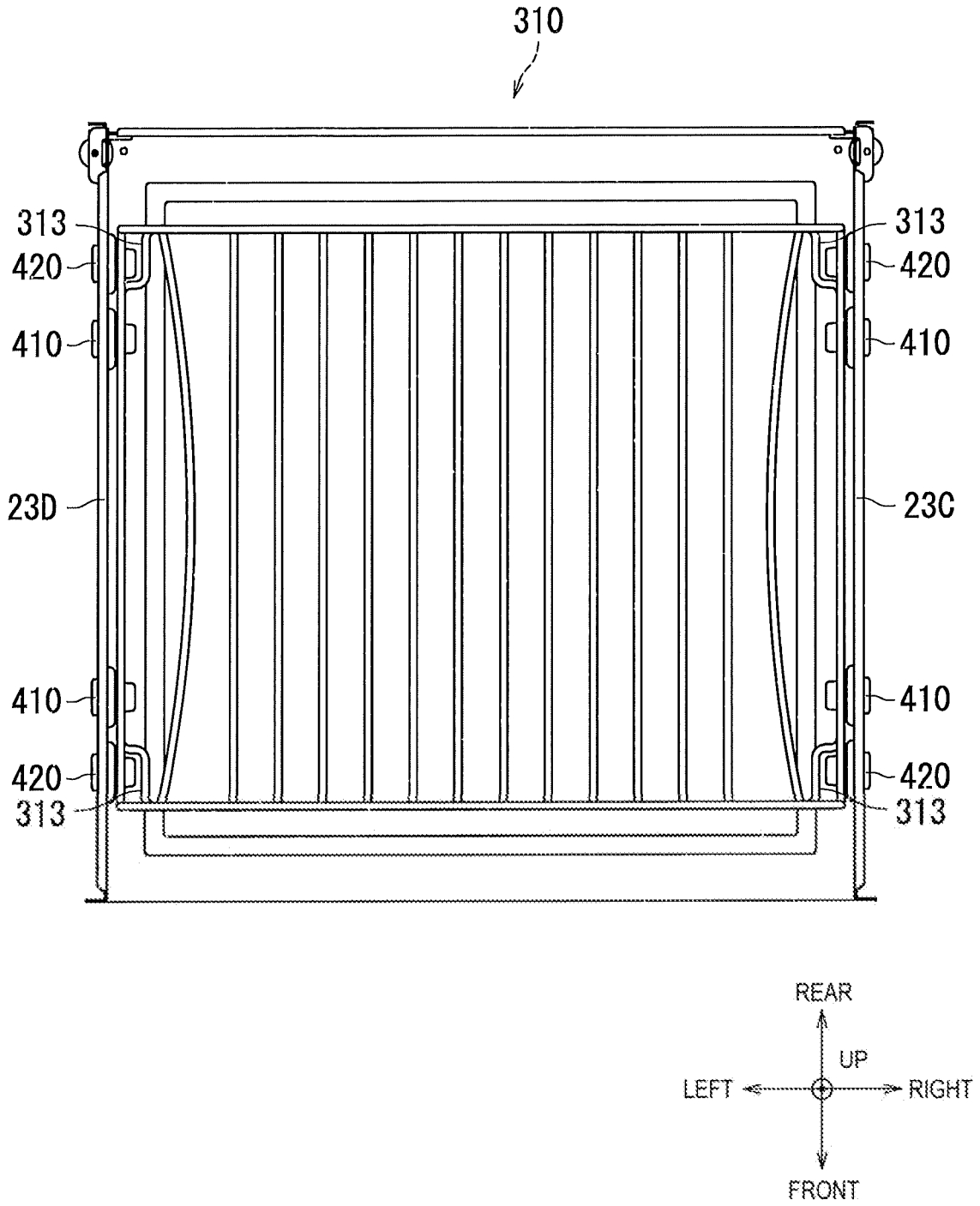
FIG. 9 is a top view of the grid bodies according to the present embodiment.

Next, a method of using the grid bodies 300 will be described with reference to FIG. 9. FIG. 9 is a top view of the grid bodies 300. As illustrated in FIG. 9, at the time of attachment, a user first moves the drawer body 2 to the drawn-out position. In other words, the support portion 23 is moved to the drawn-out position.

The user engages the first grid body 310 with the plurality of first engagement portions 410. In other words, when the support portion 23 is at the drawn-out position, the first grid body 310 is engageable with the plurality of first engagement portions 410. Specifically, the first grid body 310 further includes a recessed portion 313 corresponding to the position of the second engagement portion 420 with respect to the support portion 23. Specifically, the recessed portion 313 is provided in each of the four corners of the first grid body 310. As a result, the user can engage, from above, the first grid body 310 with the plurality of first engagement portions 410. Furthermore, movement in the horizontal direction does not occur during the attachment, and thus the heated object H can be suppressed from falling out of the placement portion 312. In addition, providing the recessed portions 313 in the first grid body 310 allows for increasing the area of the placement portion 312, that is, the area in which the heated object H can be placed. More specifically, each of the first high portion 311A and the second high portion 311C is engaged with the first engagement portion 410, and the low portion 311B is disposed between the first engagement portion 410 and the first engagement portion 410. As a result, the first high portion 311A, the low portion 311B, and the second high portion 311C restrict the movement of the first grid body 310 with respect to the support portion 23.

Next, the user engages the second grid body 320 with the plurality of second engagement portions 420. In other words, when the support portion 23 is at the drawn-out position, the second grid body 320 is engageable with the plurality of second engagement portions 420. The user engages, from above, the second grid body 320 with the plurality of second engagement portions 420. As a result, the second grid body 320 is disposed on the support portion 23 and above the first grid body 310. Furthermore, movement in the horizontal direction does not occur during the attachment, and thus the heated object H can be suppressed from falling out of the placement portion 322. More specifically, each of the first high portion 321A and the second high portion 321C is engaged with the second engagement portion 420, and the low portion 321B is disposed between the second engagement portion 420 and the second engagement portion 420. As a result, the first high portion 321A, the low portion 321B, and the second high portion 321C restrict the movement of the second grid body 320 with respect to the support portion 23.

Upon removal, the user first moves the drawer body 2 to the drawn-out position. In other words, the support portion 23 is moved to the drawn-out position. The user removes the second grid body 320 from the plurality of second engagement portions 420. Specifically, the user removes the second grid body 320 upward from the plurality of second engagement portions 420. As a result, movement in the horizontal direction does not occur during the removal, and thus the heated object H can be suppressed from falling out of the placement portion 322.

Next, the user removes the first grid body 310 from the plurality of first engagement portions 410. Specifically, since the first grid body 310 has the recessed portions 313, the user can remove the first grid body 310 upward from the plurality of first engagement portions 410. As a result, movement in the horizontal direction does not occur during the removal, and thus the heated object H can be suppressed from falling out of the placement portion 312.

Figure 10:
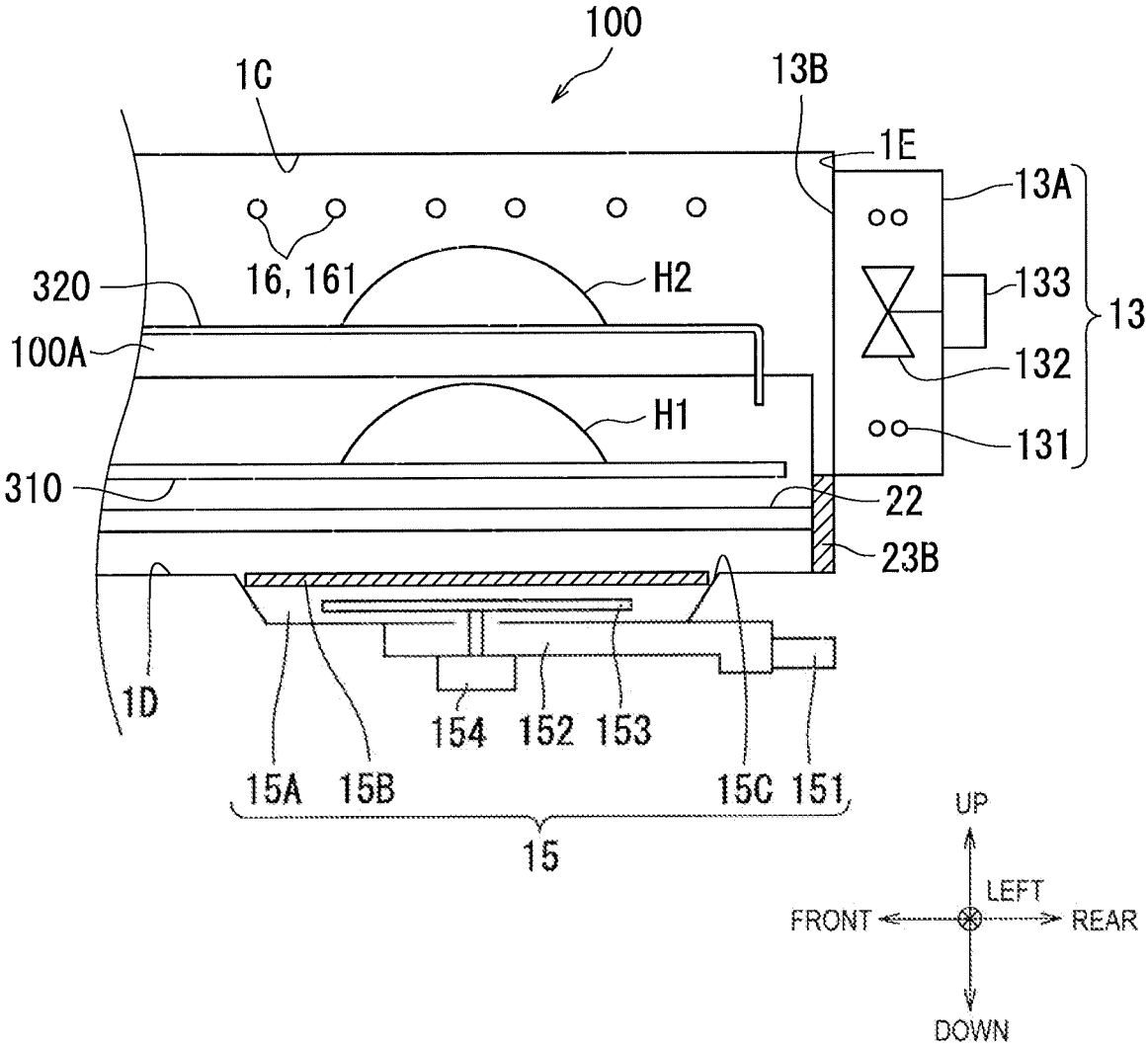
FIG. 10 is a cross-sectional view of the heating chamber taken along a plane orthogonal to the second direction according to the present embodiment.

Next, with reference to FIG. 10, the heating chamber 1 will be further described. FIG. 10 is a schematic cross-sectional view of the heating chamber 1. Specifically, FIG. 10 is a cross-sectional view of the heating chamber 1 taken along a plane orthogonal to the second direction D2.

As illustrated in FIG. 10, the drawer type heating cooking apparatus 100 further includes a microwave supply unit 15 and a partition member 15B. The microwave supply unit 15 supplies microwaves into the heating cooking chamber 100A.

The microwave supply unit 15 is located outside the heating cooking chamber 100A with bottom wall 1D interposed therebetween. The microwave supply unit 15 includes a radiation chamber 15A, a magnetron 151, a waveguide 152, a rotary antenna 153, and an antenna motor 154. The magnetron 151 generates microwaves. The microwaves generated by the magnetron 151 are propagated through the waveguide 152 to the radiation chamber 15A.

The radiation chamber 15A has a radiation port 15C. The shape of the radiation port 15C is, for example, a square. The radiation port 15C is located below the heating cooking chamber 100A. Specifically, the radiation port 15C is located in a substantially central portion of the bottom wall 1D. The rotary antenna 153 is accommodated in the radiation chamber 15A. The antenna motor 154 drives the rotary antenna 153. The rotary antenna 153 agitates the microwaves and supplies the microwaves into the heating cooking chamber 100A through the radiation port 15C.

The partition member 15B covers the radiation port 15C. The partition member 15B may have any shape that can cover the radiation port 15C. The partition member 15B is preferably a plate-like member. Furthermore, when viewed in the vertical direction, the shape of the partition member 15B is, for example, a square.

The material of the partition member 15B includes ceramic or glass. As a result of inclusion of ceramic or glass in the material of the partition member 15B, the partition member 15B transmits microwaves. On the other hand, the materials of the radiation chamber 15A and the waveguide 152 includes metal.

As described above with reference to FIGS. 1 to 10, according to the first embodiment, the grid body 300 is engaged with the engagement portion 400. Thus, it is possible to suppress movement of the grid body 300 with respect to the drawer body 2 caused by impact when the drawer body 2 moves. As a result, it is possible to suppress the distance between the grid body 300 and the drawer body 2 from being too short. Thus, occurrence of discharge between the grid body 300 and the drawer body 2 can be suppressed.

Further, the grid body 300 preferably includes the first grid body 310 and the second grid body 320. A large quantity of the heated objects H1 and H2 can be heated without increasing the size. In addition, the first grid body 310 is engaged with the first engagement portion 410, and the second grid body 320 is engaged with the second engagement portion 420. Thus, it is possible to suppress movement of the first grid body 310 with respect to the drawer body 2 caused by impact when the drawer body 2 moves. In addition, it is possible to suppress movement of the second grid body 320 with respect to the drawer body 2 caused by impact when the drawer body 2 moves. Thus, occurrence of discharge between the first grid body 310 and the drawer body 2 can be suppressed. In addition, occurrence of discharge between the second grid body 320 and the drawer body 2 can be suppressed. Furthermore, occurrence of discharge between the first grid body 310 and the second grid body 320 can be suppressed.

The first high portion 311A, the low portion 311B, and the second high portion 311C restrict movement of the first grid body 310 with respect to the support portion 23. Furthermore, the first high portion 321A, the low portion 321B, and the second high portion 321C restrict movement of the second grid body 320 with respect to the support portion 23. Thus, the first grid body 310 and the second grid body 320 can always be disposed at a predetermined position in the support portion 23. As a result, occurrence of discharge between the first grid body 310 and the drawer body 2 can be further suppressed. In addition, occurrence of discharge between the second grid body 320 and the drawer body 2 can be further suppressed. Further, occurrence of discharge between the first grid body 310 and the second grid body 320 can be further suppressed.

More specifically, as illustrated in FIGS. 5 and 7, in the placement portion 312, a metal rod 312A, which is one of the plurality of metal rods and is on one side in the second direction D2, and a metal rod 312B, which is one of the plurality of metal rods and is on the other side in the second direction D2, are curved toward each other. Specifically, in the placement portion 312, the metal rod 312A, which is the leftmost one of the plurality of metal rods, and the metal rod 312B, which is the rightmost one of the plurality of metal rods, are curved toward each other. Thus, a large quantity of the heated objects H1 and H2 can be heated. In addition, a user easily inserts one hand with a glove between the metal rod 312A and the left plate portion 23D, and easily inserts the other hand with a glove between the metal rod 312B and the right plate portion 23C. As a result, the user easily removes the first grid body 310 from the support portion 23.

More specifically, as illustrated in FIGS. 5 and 8, in the placement portion 322, a metal rod 322A, which is one of the plurality of metal rods and is on one side in the second direction D2, and a metal rod 322B, which is one of the plurality of metal rods and is on the other side in the second direction D2, are curved toward each other. Specifically, in the placement portion 322, the metal rod 322A, which is the leftmost one of the plurality of metal rods, and the metal rod 322B, which is the rightmost one of the plurality of metal rods, are curved toward each other. Thus, the user can grasp the metal rod 322A by one hand with a glove, and can grasp the metal rod 322A by the other hand with a glove. As a result, the user easily removes the second grid body 320 from the support portion 23.

More specifically, the first grid body 310 further includes a heated object restricting portion 312C. The heated object restricting portion 312C restricts movement of the heated object H1 with respect to the first grid body 310. The heated object restricting portion 312C is located at the center of the placement portion 312. Specifically, the heated object restricting portion 312C is a recessed portion recessed downward. More specifically, the plurality of metal rods in the placement portion 322, excluding the metal rod 322A at a leftmost position, a metal rod adjacent to the metal rod 322A, the metal rod 322B at a rightmost position, and a metal rod adjacent to the metal rod 322B, are curved downward. Therefore, it is possible to further suppress the heated object H1 from falling out of the first grid body 310 due to impact when the drawer body 2 moves. In addition, since each of the plurality of metal rods of the placement portion 312 has the curved portion, effects of reinforcing wires of the metal rods and preventing deflection can be achieved.

As illustrated in FIG. 10, the drawer type heating cooking apparatus 100 further includes a grill unit 16. Specifically, the grill unit 16 includes a heater 161 and an energization unit. The heater 161 is located in the heating cooking chamber 100A, and heats the heated object H. Specifically, the heater 161 is located on an upper portion in the heating cooking chamber 100A. The heater 161 has substantially a U-shape when viewed in the vertical direction. In the present embodiment, three grill units 16 are disposed. The heater 161 is, for example, a sheathed heater. The energization unit is located outside the heating cooking chamber 100A. The energization unit energizes the heater 161. The energized heater 161 generates heat.

According to the drawer type heating cooking apparatus 100 of the disclosure, the heater 161 is provided in an upper portion in the heating cooking chamber 100A, and the microwave supply unit 15 is provided below the heating cooking chamber 100A. Thus, heat generated by the heater 161 is conducted to the top surface of the heated object H, and therefore the top surfaces of the heated objects H1 and H2 can be efficiently heated. Furthermore, the irradiation of the heated object H with microwaves is not inhibited by the heater 161.

Figure 11:
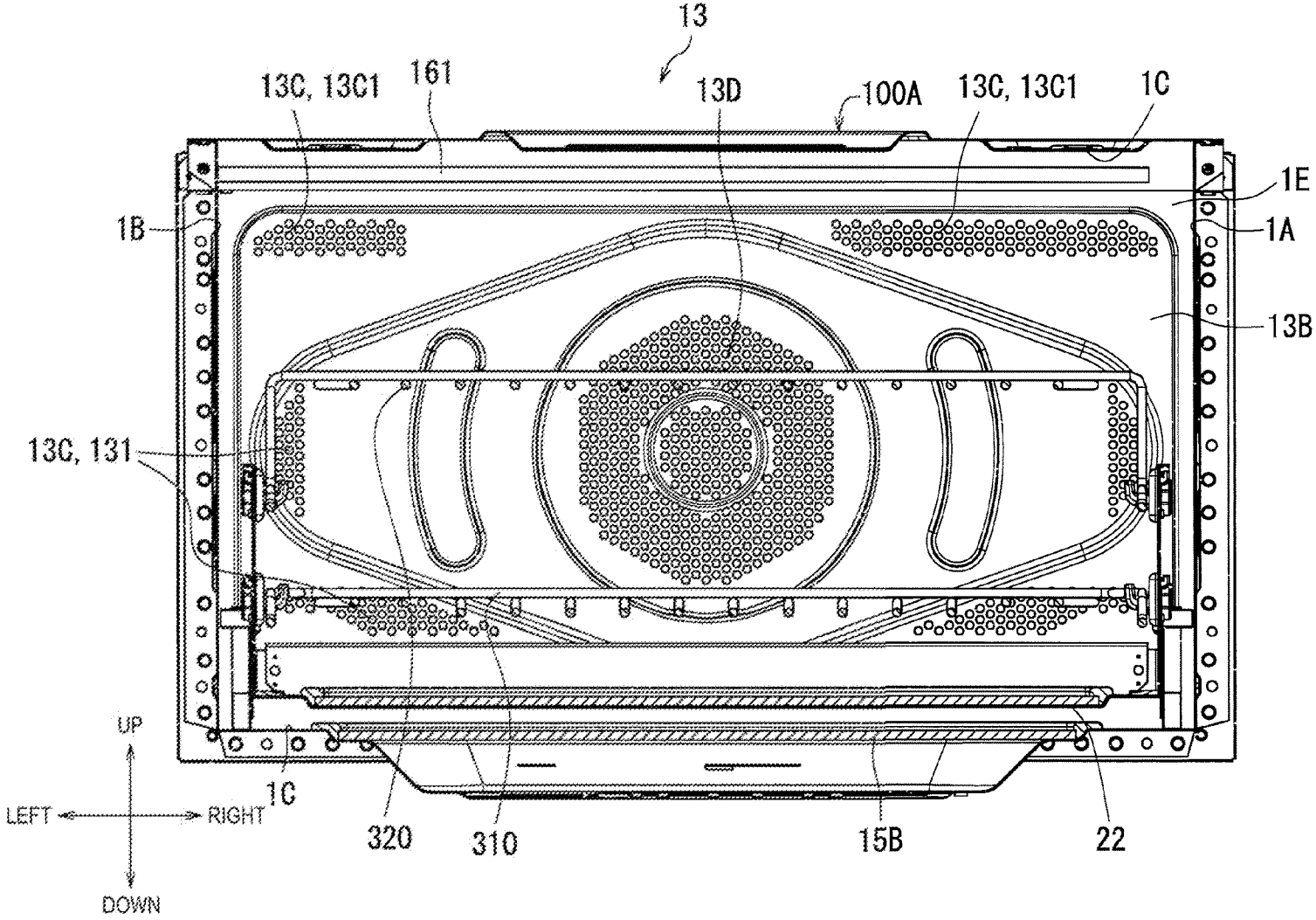
FIG. 11 is a cross-sectional view of the heating chamber taken along a plane orthogonal to the first direction according to the present embodiment.

Next, an air sending unit 13 will be further described with reference to FIGS. 10 and 11. FIG. 11 is a cross-sectional view of the heating chamber 1 taken along a plane orthogonal to the first direction D1. As illustrated in FIG. 11, the drawer type heating cooking apparatus 100 further includes the air sending unit 13. The air sending unit 13 supplies hot air into the heating cooking chamber 100A.

Specifically, the air sending unit 13 includes a suction hole 13D, a plurality of blow-out holes 13C, and a partition member 13B. The suction hole 13D is located on the opposite side in the first direction D1 with respect to the accommodation space 120. Each of the plurality of blow-out holes 13C is located on the opposite side in the first direction D1 with respect to the accommodation space 120. Specifically, the air sending unit 13 is located rearward of the heating cooking chamber 100A, and the back wall 1E is interposed therebetween. The suction hole 13D is located rearward with respect to the accommodation space 120. Each of the plurality of blow-out holes 13C is located rearward with respect to the accommodation space 120.

The air sending unit 13 takes in hot air in the heating cooking chamber 100A through the suction hole 13D and blows out hot air into the heating cooking chamber 100A through the plurality of blow-out holes 13C. More specifically, the air sending unit 13 takes in hot air from the central portion of the interior of the heating cooking chamber 100A and blows out hot air to the peripheral edge in the heating cooking chamber 100A. As a result, the entire heating cooking chamber 100A can be heated by driving the air sending unit 13.

More specifically, the air sending unit 13 further includes an air sending chamber 13A, a heater 131, a centrifugal fan 132, and a drive unit 133. The air sending chamber 13A is, for example, a box-like member. The centrifugal fan 132 has a plurality of blades.

The heater 131 and the centrifugal fan 132 are accommodated in the air sending chamber 13A. The heater 131 heats air in the air sending chamber 13A to generate hot air. Specifically, the shape of the heater 131 is a circular ring when viewed from the front to the rear. The heater 131 is disposed along the outer circumference of the centrifugal fan 132.

The drive unit 133 is located outside the air sending chamber 13A. The drive unit 133 energizes the heater 131 and drives the centrifugal fan 132. The drive unit 133 includes a motor and an energization unit, for example.

The partition member 13B is located rearward of the accommodation space 120. Specifically, the partition member 13B is located between the air sending chamber 13A and the heating cooking chamber 100A. The partition member 13B is, for example, a plate-like member made of metal. The shape of the partition member 13B is, for example, rectangular when viewed from the front to the rear. The partition member 13B is provided over substantially the entire surface of the back wall 1E. The suction hole 13D and the plurality of blow-out holes 13C are provided in the partition member 13B. Thus, the suction hole 13D and the blow-out holes 13C can be easily provided rearward of the accommodation space 120.

Specifically, the suction hole 13D is, for example, a group of a plurality of punched holes. Similarly, the blow-out hole 13C is also a group of a plurality of punched holes, for example. The punched hole is circular, for example. The diameter of the punched holes in each of the suction hole 13D and the blow-out hole 13C is, 3.4 mm, for example. Thus, the size of the suction hole 13D and the blow-out hole 13C is small. As a result, during cleaning the interior of the heating cooking chamber 100A, it is possible to suppress a tool or the like from being caught in each of the suction hole 13D and the blow-out hole 13C.

More specifically, the blow-out hole 13C is disposed along the outer periphery of the partition member 13B. Specifically, the suction hole 13D is located at the center of the partition member 13B. The blow-out hole 13C includes a peripheral blow-out hole 13C1.

The peripheral blow-out hole 13C1 is located at the periphery along the edge of the back wall 1E. The peripheral blow-out hole 13C1 is formed to make the temperature in the heating cooking chamber 100A uniform.

The flow of hot air will now be described in detail. First, the air sending unit 13 takes in, by the centrifugal fan 132, hot air in the heating cooking chamber 100A, through the suction hole 13D into the air sending chamber 13A. The hot air taken into the air sending chamber 13A is heated by the heater 131. The air sending unit 13 blows out, by the centrifugal fan 132, hot air in the air sending chamber 13A, through the blow-out hole 13C into the heating cooking chamber 100A. The hot air blown into the heating cooking chamber 100A from the peripheral blow-out hole 13C1 moves primarily forward along the right wall 1A and the left wall 1B. Thereafter, once the hot air reaches the rear surface 21B of the door portion 21, the hot air reverses the movement direction and moves rearward. Then, the hot air reaches the heated objects H1 and H2 and moves rearward along the heated objects H1 and H2. The hot air moving rearward moves in the heating cooking chamber 100A. Thereafter, the hot air is taken into the air sending chamber 13A from the suction hole 13D again. In this way, the air sending unit 13 circulates hot air between the interior of the air sending chamber 13A and the interior of the heating cooking chamber 100A.

As described above, according to the drawer type heating cooking apparatus 100, the blow-out hole 13C includes the peripheral blow-out hole 13C1. Thus, the heated objects H1 and H2 placed on the grid body 300 can be more uniformly heated.

Figure 12:
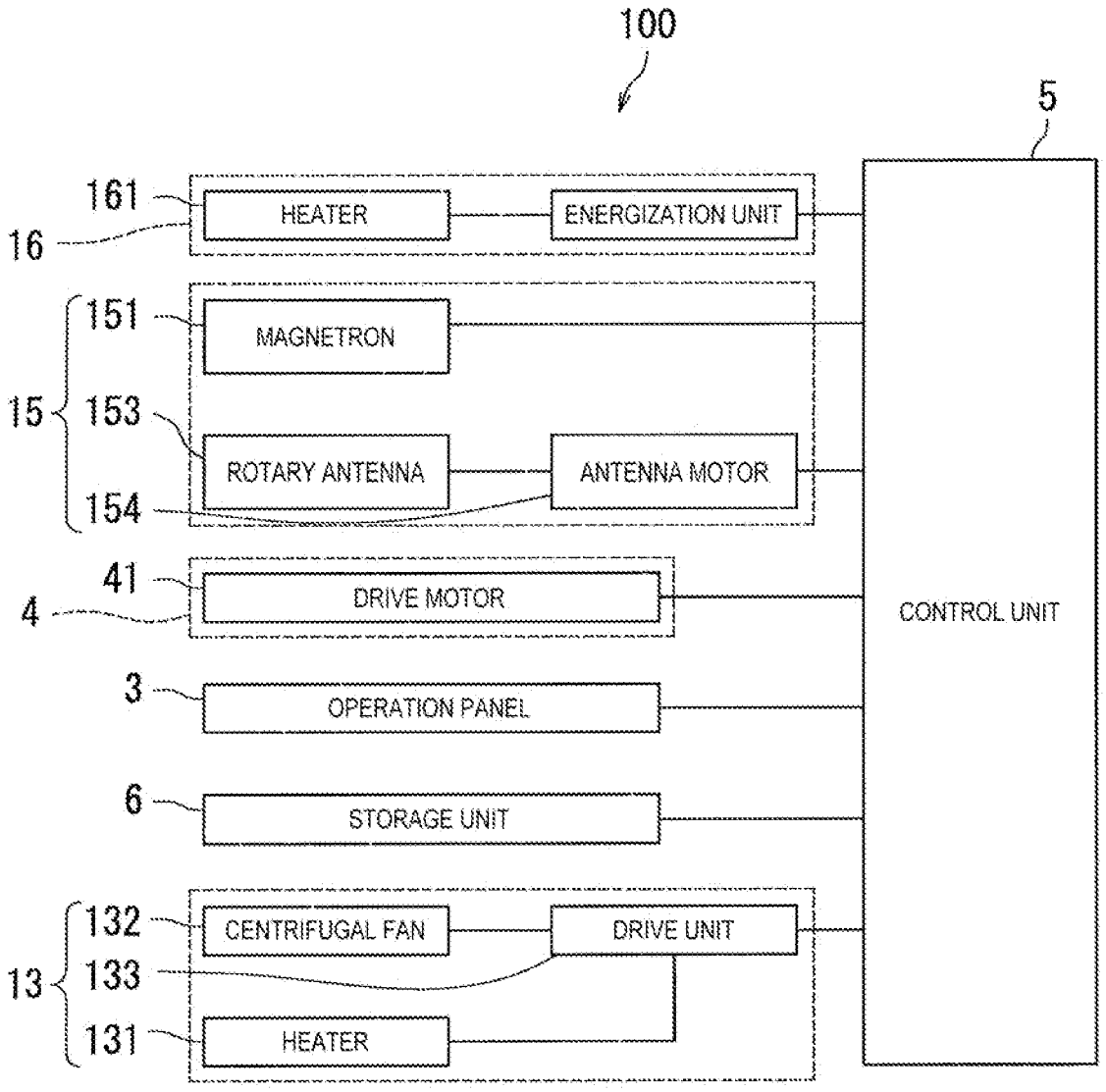
FIG. 12 is a block diagram illustrating a configuration of the drawer type heating cooking apparatus according to the present embodiment.

With reference to FIG. 12, the configuration of the drawer type heating cooking apparatus 100 will be described in detail. FIG. 12 is a block diagram illustrating the configuration of the drawer type heating cooking apparatus 100. In the present embodiment, heating cooking modes in the drawer type heating cooking apparatus 100 include "a microwave heating mode", "a hot air circulation heating mode", and "a grill heating mode". The "microwave heating mode" is a mode in which the heated objects H1 and H2 are mainly heated and cooked through radiation of microwaves in the heating cooking chamber 100A. The "grill heating mode" is a mode for mainly heating and cooking the heated objects H1 and H2 by conducting heat generated by the heater 161 to the heated objects H1 and H2. The "hot air circulation heating mode" is a mode for mainly heating and cooking the heated objects H1 and H2 by circulating hot air throughout the interior of the heating cooking chamber 100A to achieve uniformity in temperature in the heating cooking chamber 100A.

The control unit 5 executes the control programs stored in the storage unit 6 to control the drive unit 133, the magnetron 151, the antenna motor 154, the energization unit, the drive motor 41, the operation panel 3, and the storage unit 6.

Specifically, the control unit 5 controls driving of the microwave supply unit 15, driving of the air sending unit 13, and driving of the grill unit 16. For example, in a case where the "microwave heating mode" is selected, the control unit 5 drives the magnetron 151 and the antenna motor 154. In a case where the "grill heating mode" is selected, the control unit 5 energizes the energization unit. Furthermore, in a case where the "hot air circulation heating mode" is selected, the control unit 5 drives the drive unit 133. The drive unit 133 energizes the heater 131 and drives the centrifugal fan 132.

Figure 13:
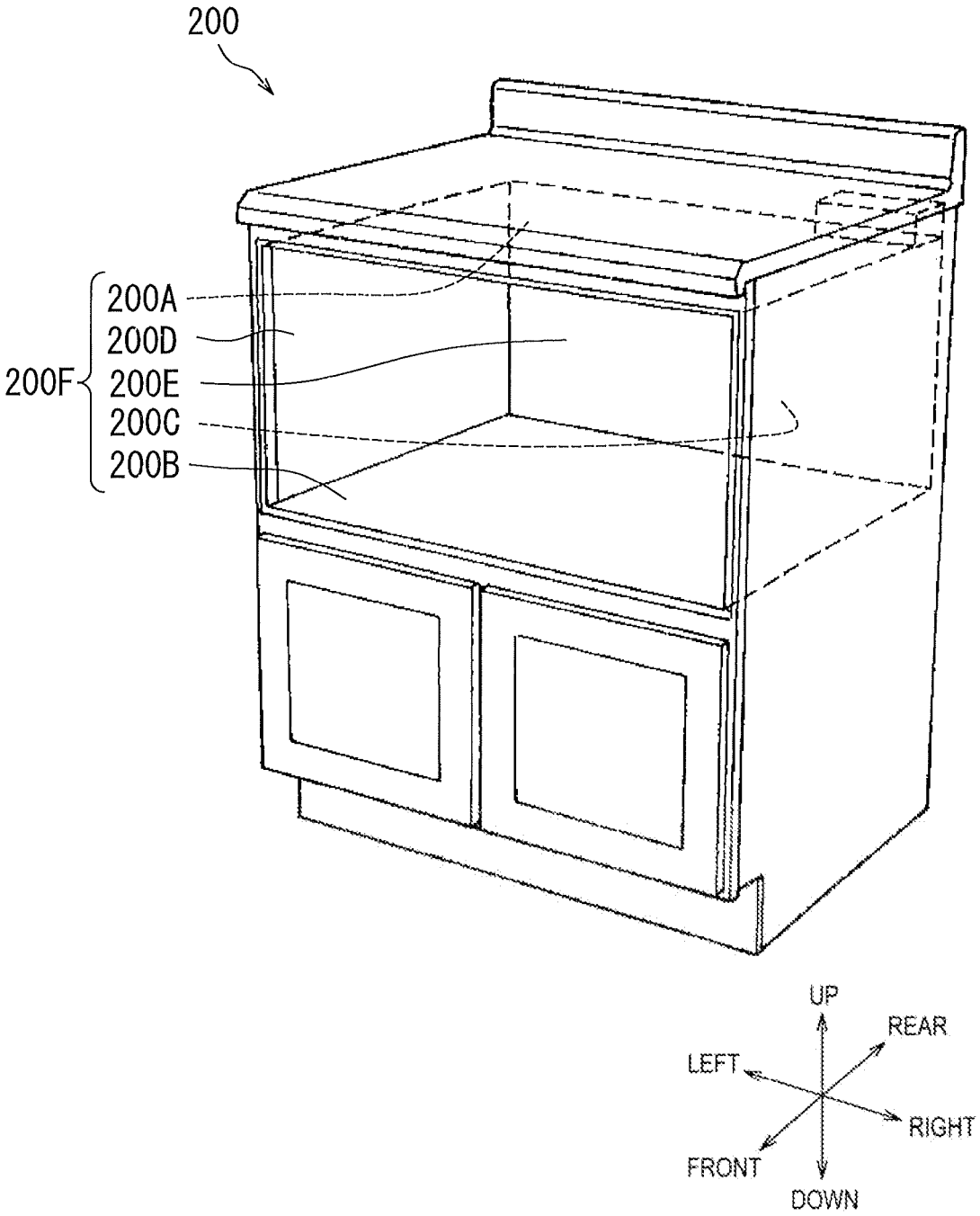
FIG. 13 is a perspective view of a cabinet to which the drawer type heating cooking apparatus according to the present embodiment is attached.

Next, a cabinet 200 to which the drawer type heating cooking apparatus 100 is attached will be described with reference to FIG. 13. FIG. 13 illustrates the cabinet 200 to which the drawer type heating cooking apparatus 100 is attached.

As illustrated in FIG. 13, the drawer type heating cooking apparatus 100 is attached to and installed in the cabinet 200. The cabinet 200 includes an upper wall 200A, a lower wall 200B, a right wall 200C, a left wall 200D, and a rear wall 200E. The upper wall 200A, the lower wall 200B, the right wall 200C, the left wall 200D, and the rear wall 200E form an accommodation portion 200F. The accommodation portion 200F is a rectangular parallelepiped space into which the drawer type heating cooking apparatus 100 is fitted.

The embodiments of the present disclosure are described above with reference to the drawings. However, the present disclosure is not limited to the embodiments described above, and it is possible to implement the present disclosure in various aspects without departing from the gist thereof. The drawings primarily and schematically illustrate each of the constituent elements for the sake of easier understanding, and the thickness, length, number, and the like of each of the illustrated constituent elements are different from the actual thickness, length, number, and the like by reason of making of the drawings. Further, the material, shape, dimensions, and the like of each of the constituent elements illustrated in the embodiment described above are merely exemplary and are not limiting, and various modifications can be made within the scope not departing from the effects of the present disclosure in essence.

(1) As described with reference to FIGS. 1 to 13, the drawer type heating cooking apparatus 100 includes the plurality of engagement portions 400 disposed on the support portion 23, but the present disclosure is not limited thereto. For example, the engagement portion 400 may be fitted into the support portion 23 so as to be detachably attached to the support portion 23. Note that when the engagement portion 400 is fitted into the support portion 23, the engagement portion 400 may include an anti-falling structure or an anti-rotation structure.

(2) As described with reference to FIGS. 1 to 13, the second grid body 320 does not further include a heated object restricting portion, but the present disclosure is not limited thereto. The second grid body 320 may further include a heated object restricting portion. The heated object restricting portion is provided at the center of the placement portion 322. Specifically, the heated object restricting portion is a recessed portion recessed downward. Therefore, it is possible to suppress the heated object H2 from falling out of the second grid body 320 due to impact when the drawer body 2 moves. In addition, since each of the plurality of metal rods of the placement portion 322 has the curved portion, effects of reinforcing wires of the metal rods and preventing deflection can be achieved.

(3) As described with reference to FIGS. 1 to 13, the drawer type heating cooking apparatus 100 includes the air sending unit 13, but the present disclosure is not limited thereto. For example, the drawer type heating cooking apparatus 100 may further include an air sending unit different from the air sending unit 13.

(4) As described with reference to FIGS. 1 to 13, each of the blow-out hole 13C and the suction hole 13D is a group of a plurality of punched holes, but the present disclosure is not limited thereto. For example, each of the blow-out hole 13C and the suction hole 13D may be one opening or a plurality of slit holes, or may have a grid shape.

INDUSTRIAL APPLICABILITY

The present disclosure is useful in the field of a heating cooking apparatus, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A heating cooking apparatus, comprising:

a microwave generator supplying microwaves to a heating cooking chamber;

a drawer portion drawable with respect to the heating cooking chamber; and a grid body made of metal, a heated object being placed on the grid body, wherein the drawer portion includes a moving body made of metal, the moving body being configured to move between an accommodation position inside the heating cooking chamber and a drawn-out position outside the heating cooking chamber, and an engagement portion made of non-metallic material, the engagement portion being disposed on the moving body, when the moving body is at the drawn-out position, the grid body is engageable with the engagement portion, wherein the grid body includes a first grid body and a second grid body, the engagement portion includes a first engagement portion and a second engagement portion, the first grid body is configured to engage with the first engagement portion, the second grid body is configured to engage with the second engagement portion, the second engagement portion is disposed on the moving body and above the first engagement portion, the second grid body is disposed in the moving body and above the first grid body, and the first grid body includes a first recessed portion corresponding to a position of the second engagement portion disposed on the moving body.

2. The heating cooking apparatus according to claim 1, wherein the grid body includes a grid body restricting edge restricting portion movement of the grid body with respect to the moving body when the grid body engages with the engagement portion.

3. The heating cooking apparatus according to claim 1,

Wherein the first grid body includes a second recessed portion restricting movement of the heated object with respect to the first grid body.

4. The heating cooking apparatus according to claim 1, further comprising:

a heater configured to heat the heated object placed on the grid body.

* * * * *